United States Patent [19]

Francis

[11] 4,053,131

[45] Oct. 11, 1977

[54] PAINT CAN HOLDER

[76] Inventor: James R. Francis, 8450 W. 95th St., Hickory Hills, Ill. 60457

[21] Appl. No.: 671,313

[22] Filed: Mar. 29, 1976

[51] Int. Cl.[2] ..... E06C 7/14

[52] U.S. Cl. ..... 248/211; 248/210; 248/318; 224/45 C

[58] Field of Search ..... 248/210, 211, 214, 311.1, 248/311.3, 318; 224/45 AA, 45 BA, 45 C; 294/33; 403/389, 400, 406

[56] References Cited

U.S. PATENT DOCUMENTS

| | | | |
|---|---|---|---|
| 1,178,965 | 4/1916 | Stroecker | 248/210 |
| 1,283,160 | 10/1918 | Gross | 248/210 |
| 1,515,418 | 11/1924 | Smith | 248/316 D X |
| 1,515,622 | 11/1924 | Sarlabous et al. | 294/33 |
| 1,522,876 | 1/1925 | Genebach | 211/181 |
| 1,854,069 | 4/1932 | Rowe | 248/210 |
| 2,960,601 | 11/1960 | Higgins | 248/311.1 X |
| 3,160,383 | 12/1964 | Lamm | 248/211 |
| 3,180,605 | 4/1965 | Ewaskowitz | 248/311.1 X |

FOREIGN PATENT DOCUMENTS

| | | | |
|---|---|---|---|
| 837,829 | 5/1952 | Germany | 211/86 |

*Primary Examiner*—William H. Schultz
*Attorney, Agent, or Firm*—John J. Kowalik

[57] ABSTRACT

A novel paint can holder or hanger comprising a bar having a vertical body portion with a furcated lower end defining an inverted V-shaped paint can lip-receiving slot and having an inner leg adapted to extend into the open end of the can and an outer leg overlapping the outer side of the can. The inner and outer legs have opposing notches on their inner edges for receiving the inner and outer edges of the lip. The vertical body portion has on its outer side a bail-entrapping notch arrangement which serves as a fulcrum for the holder when the holder is lifted by handle at the upper end of the body portion, the handle extending to the axial center line of the can. A flexible tether is secured to the handle and is adapted to be looped over a rung of a ladder or the like.

12 Claims, 8 Drawing Figures

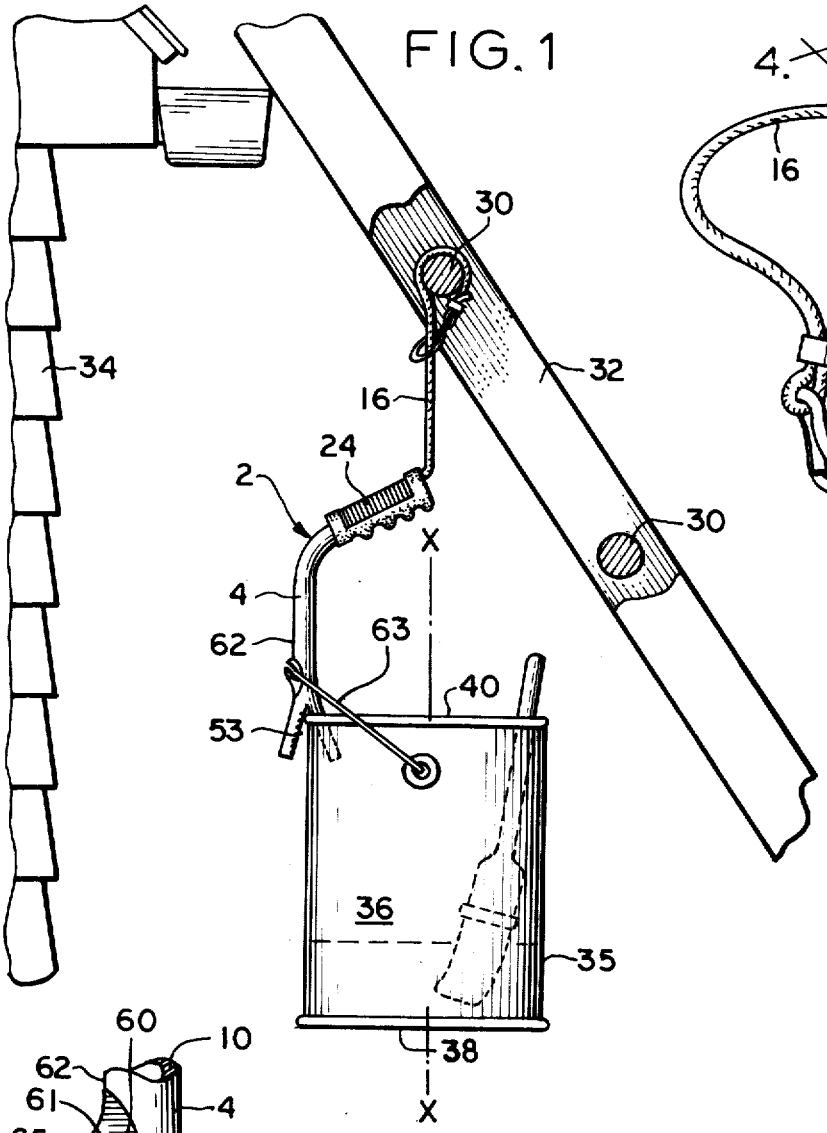
FIG. 1
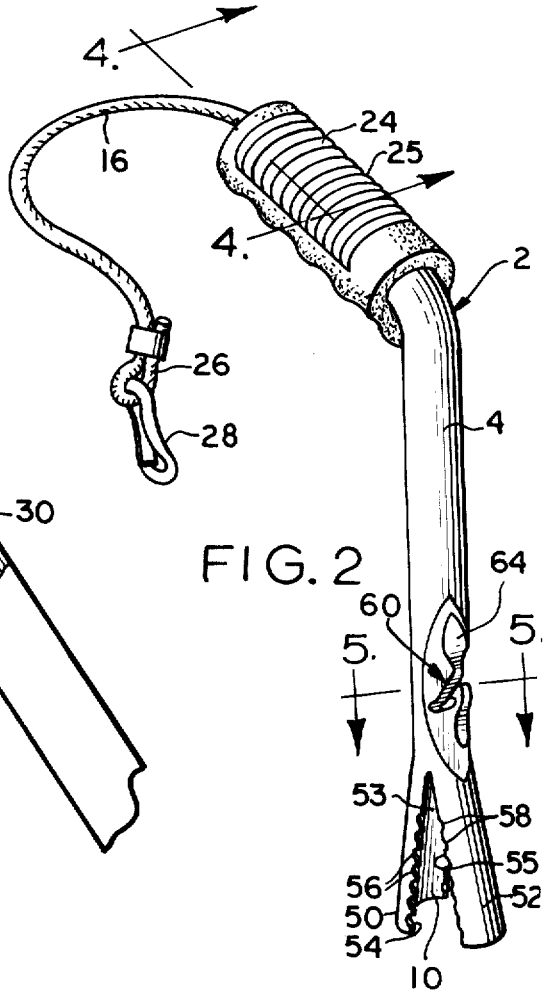
FIG. 2
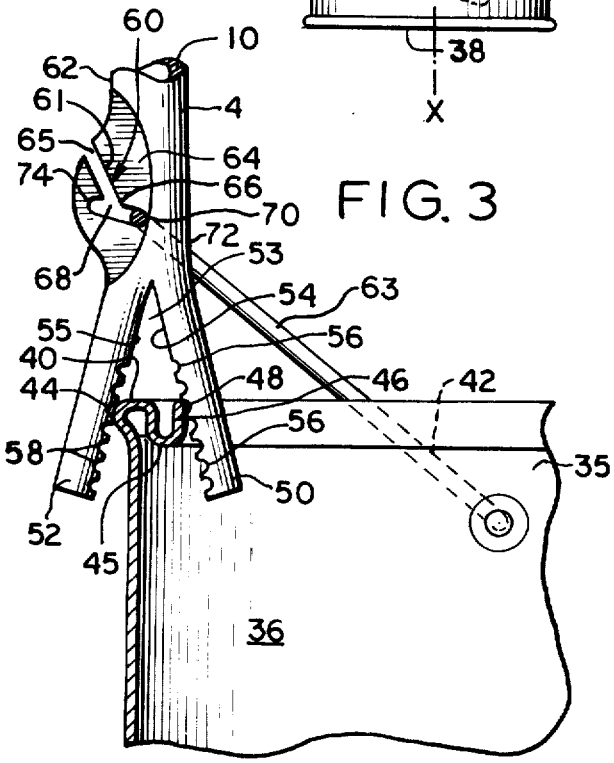
FIG. 3
FIG. 5
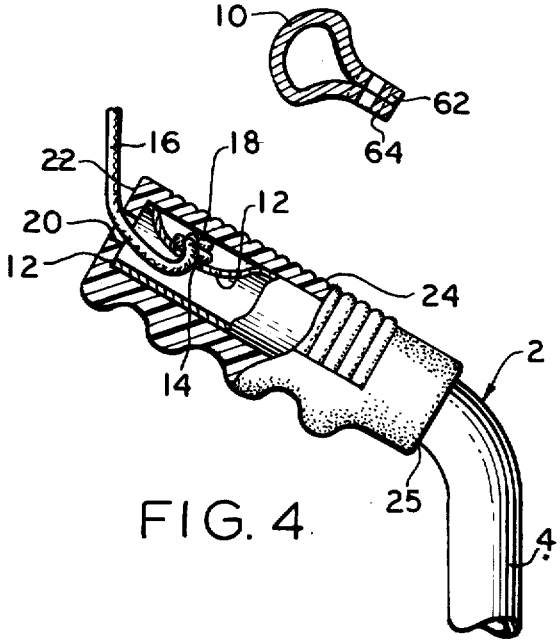
FIG. 4

PAINT CAN HOLDER

DISCUSSION OF THE ART

Various paint can holder devices have been proposed. They include devices for attachment to the bail and comprise various hooking devices for attachment to the rung of a ladder. Such devices have either been of multipart construction so that they are expensive to manufacture or are simple and only of limited utility.

SUMMARY

The present invention is directed to a novel paint can holder which is of one-piece construction and which is relatively simple to manufacture and effective in use.

A principal object of the invention is to provide a holder which incorporates a novel looking means for interlocking the holder with the lip of a paint can and which has a bail entrapping notch to prevent disengagement of the bail from the holder when the user releases the holder and sets the can down upon some support surface.

Specifically it is an object of the invention to provide a novel bail interlock for the holder to prevent the holder from falling into the paint when the holder is released.

These and other objects and advantages inherent in an encompassed state in the invention will become more readily apparent from the specification and the drawings, wherein:

FIG. 1 is a view of a paint can and holder assembly suspended from a ladder supported from a building fragmentarily shown;

FIG. 2 is an enlarged perspective view of the holder;

FIG. 3 is an enlarged fragmentary side elevational view of the lower end portion of the holder in association with the bail and lip of the paint can;

FIG. 4 is a fragmentary enlarged side elevational view of the upper end portion of the holder; and FIG. 5 is a cross-sectional view taken substantially on line 5—5 of FIG. 2.

FIG. 6 is a side elevational view of another embodiment of the invention partly in vertical section;

FIG. 7 is a fragmentary side elevational view of still another embodiment of the invention; and FIG. 8 is a fragmentary side elevational view of another embodiment of the invention.

DESCRIPTION OF THE INVENTION: FIGS. 1-5

Figure 6:
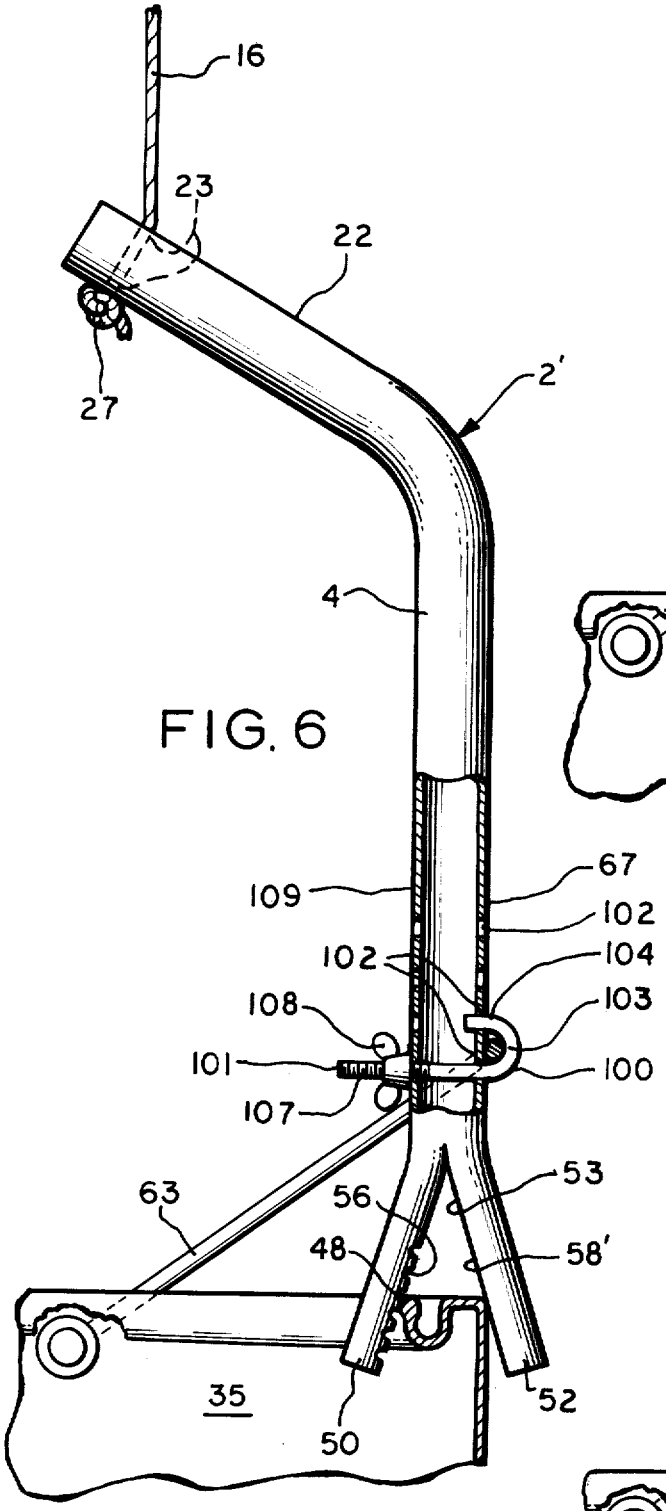
FIGS. 6–8 illustrate further embodiments.

Referring to the drawings, there is shown a paint can holder or hanger designated 2 of generally V-shape having a substantially vertical upright body or post portion 4 and an upper handle portion 6 extending diagonally upwardly to a distal end 8 at an angle of about 45° to the body portion. The structure is preferably fabricated from a tube.

The wall 10 of the tube is indented at 12 adjacent to the end 8 and has a hole 14 drilled in the nadir of the indentation through which a flexible tether 16 is passed, one end of which has a knot 18 seated within the cavity or depression 12. The tether which may be an elasticized or braided nylon cord is extended through an opening 20 in an end wall 22 of a hand grip 24, which has a tubular body portion 25 sleeved over the complemental tubular handle portion of the holder. Thus the portion 25 covers the knot 18 and traps it within the depression 12. The other end of the tether may be formed with an eye 26 which is secured to a snap hook 28 which is shown looped over a rung 30 of a ladder 32, leaning against a building 34. It will be seen that the distal end of the handle terminates at the axial center line X—X of the paint can 35 suspended therebelow.

The paint can 35 has a body 36, a bottom 38 and a lip portion 40 about its upper end defining an access opening 42.

The lip 40 of a conventional paint can has an outwardly projecting head 44, and at its inner edge has a V-shaped channel 45 which along its inner edge is defined by an annular wall 46 which is formed with a bead 48 along its upper edge. The lip 40 is straddled by the furcations or inner and outer legs 50 and 52 at the lower end of the vertical body portion of the holder. The legs 50, 52 define an inverted V-shaped slot or mouth 53 via which the holder is positioned on the container lip or rim 40. As best seen in FIG. 3, the inner opposing edges 54, 55 of legs 50, 52 are provided with notches 56, 58 into which the beads 48, 44 are snapped, thus partially retaining the holder in association with the pail.

The body portion of the holder has a bail interlock generally designated 60 comprising a bail-admitting notch 61 which slopes downwardly and inwardly from the outer side 62 of the holder and is formed in a pinched flattened portion 64 of the tube. The notch has an upper end inlet end 65, at the outer side 62 of the body portion of the holder and terminates at its lower end 66 at a point intermediate the ends of a locking slot 68 which also slopes downwardly and inwardly to a lower terminal end 70 intermediate the outer and inner sides 62, 72 of the post or body portion 4 of the holder. The notch or passage 61 slopes at about 60°–75° to the vertical and the slot 68 slopes about 35°–50° to the vertical. It will become apparent that when the bail 63 or handle of the pail or can is admitted into the slot 61, it can be manipulated to slide down to slot 68, and upon lifting of the holder by the handle the bail will lodge against the inner end 70 whereby the bail serves as a fulcrum biasing the outer leg against the container while the handle is biased in a radially outward direction with respect to axis X—X.

When the handle is released it will rock with the handle radially inwardly toward axis X—X, whilst the bail rides up the lower slot 68 and engages the upper blind end 74 of the lower slot. Gravity due to the weight of the handle and its disposition biases the upper end of the holder toward the container and laterally. The holder is prevented from falling off because the inner leg acting against the inner edge of the lip causes the holder to maintain a position of leaning against the bail. The curvature of the bail and its triangular hypotenusal leg of the triangle defined by the container as the second leg and the lower portion of the post of the holder as the third leg prevent the holder from falling over laterally.

EMBODIMENT OF FIG. 6

The structure is essentially the same as the previous embodiment and the like parts are identified with the same reference numerals.

The holder 2′ comprises a handle portion 22 to which the tether 16 is attached by threading through openings 23 and knotted at 27. The furcated legs 50, 52 at the lower end of the body portion 4 embrace the lip 40 of the can 35 and the leg 50 is provided with notches 56 and the inner edge 58′ of leg 52 is straight.

The bail 63 is held against the back side 67 of the body portion or upright of the holder by a latch which differs from the latch structure 60 in structure but not in function, it being understood that all of the embodiments function essentially the same. A hook-type latch 100 is provided which has a shank 101 extending through a selected one of a series of vertically spaced openings 102. The hook end 103 of the latch has a free end leg 104 which extends through the next upper (or lower) opening and entraps the bail therein. The shank has a threaded end 107 on which is threaded a wing nut 108 which engages the inner side 109 of the vertical leg or body portion 4 of the holder and biases the hook end toward the body.

EMBODIMENT OF FIG. 7

Figure 7:
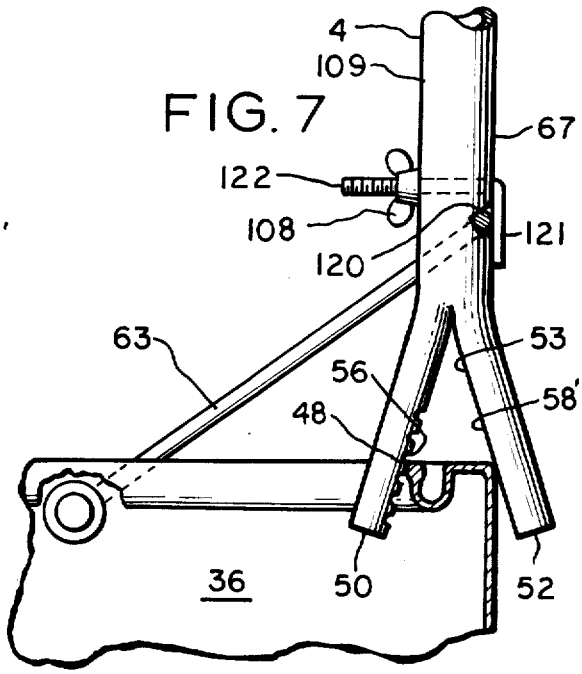
Figure 8:
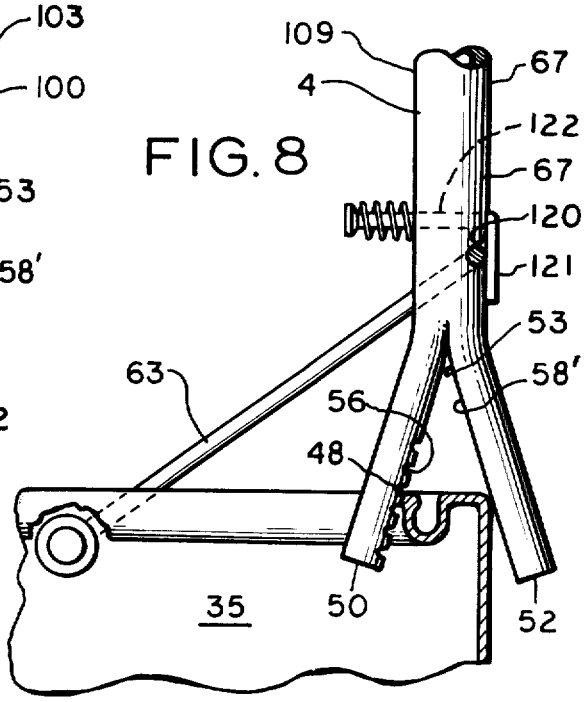

As best seen, the embodiment of FIG. 7 is similar to FIG. 6 and comprises a slot 120 in the outer edge 67 of the vertical leg 4 of the handle. The latch is L-shaped and has a vertical leg 121 which seats against the outer side 67 of the body 4 and traps the bail in the slot 121. The shank portion 122 of the latch is threaded and secured or biased by nut 108 to the body or upright portion 4.

EMBODIMENT OF FIG. 8

In this embodiment parts similar to those in the previous modifications are identified by the same reference numerals. The essential difference over FIG. 7 is that the latch has an upset end 125 on the end of shank 122, and a spring is compressed between side 109 and the end 125 and biases the leg 121 against side 67.

In compliance with the requirements of the patent laws, I have shown and described a preferred embodiment of the invention. It is, however, to be understood that the invention is not limited to the precise construction herein shown, the same being merely illustrative of the principles of the invention.

I claim:

1. A quick-attach and detach hanger for a paint container and the like having a lip defining an open top and having a carrying bail, said hanger comprising a member having an upright with an inturned handle at its upper end for positioning above the container and having a furcated lower end including inner and outer portions for receiving the lip of the can therein and having means on the furcations for interlocking with the inner and outer edges of the lip, and fulcrum means on the upright intermediate its ends for engagement with the bail, said handle upon application of a lifting force thereto operative to fulcrum said hanger about said fulcrum means and loading said bail in tension and biasing said outer portion of the furcation toward said outer edge of the lip for locking engagement therewith.

2. The invention according to claim 1 and said furcations diverging downwardly and defining a downwardly opening mouth therebetween, said furcations presenting upwardly converging opposing sides having surfaces adapted for wedging the lip of a container therebetween.

3. The invention according to claim 2 and said interlocking means comprising inwardly open notches in the opposing sides for receiving respective edges of the lip therein.

4. The invention according to claim 1 and said fulcrum means comprising bail catch means on an intermediate portion of said upright for interlocking the bail of the container therein.

5. The invention according to claim 4 and said bail catch means comprising a notch extending into said upright from a side remote from the container and sloping downwardly inwardly.

6. The invention according to claim 5 and a slot formed in said upright and connected to said slot intermediate the ends thereof for admitting the bail therein, said slot being located below said notch and said notch providing a lead-in for the bail into the slot, and said notch sloped at a greater angle than said slot and the latter having blind opposite ends to prevent escape of the bail therefrom.

7. The invention according to claim 6 and said handle extending inwardly from the upper end of the upright and sloped upwardly and having a terminal end adapted to position adjacent to the axis of the container.

8. The invention according to claim 7 and a flexible tether connected to the handle and extending therefrom and having means at its distal end for attachment to a support such as a ladder rung.

9. A hanger for a paint container and the like comprising a member having an upright with a furcated lower end for receiving the lip of a can therein and having means on the furcations for interlocking with the inner and outer edges of the lip, and bail catch means on an intermediate portion of said upright for interlocking the bail of the container therein, and said bail catch means comprising a notch extending into said upright from a side remote from the container and sloping downwardly inwardly, and a slot formed in said upright and connected to said notch intermediate the ends thereof for admitting the bail therein, said slot being located below said notch and said notch providing a lead-in for the bail into the slot, and said notch sloped at a greater angle than said slot and the latter having blind opposite ends to prevent escape of the bail therefrom, and a handle extending inwardly from the upper end of the upright and sloped upwardly and having a terminal end adapted to position adjacent to the axis of the container, and a flexible tether connected to the handle and extending therefrom and having means at the distal end for attachment to a support such as a ladder rung, and said handle being hollow and having a depression in one side thereof centered on the vertical center plane of the holder and said tether having an end extending through an opening in the wall of said handle and said handle having means providing an end wall with an opening in said plane passing said tether therethrough, said tether adapted to extend in said plane vertically above said handle.

10. The invention according to claim 1 and said fulcrum comprising bail catch means on said upright intermediate the ends thereof and said handle at the upper end of the upright disposed at an obtuse including angle thereto, said furcations and said handle and catch being located in a common plane.

11. The invention according to claim 4 and said bail latch comprising a hook element having a bail-engaging portion engagable with the bail and having a portion extending through said upright and means for biasing said bail-engaging portion against the body.

12. A holder for supporting in an upright position a container having a lip defining an upwardly open access opening and a carrying bail pivoted on the diameter of the container for swinging movement from a position at one side of the container means on said upright portion located substantially in vertical alignment with the lip of the container to an upright container-carrying position, said holder having a vertical portion, can-engaging means on the lower end of the vertical portion having a leg positioned against the outer side of of the container for engaging the external edge of the lip of the container, means on said upright portion located substantially in vertical alignment with the lip of the container intermediate the upper and lower ends thereof for latching the bail thereto; and a handle portion angled diagonally upwardly and having an extent to project over the central vertical axis of the container and providing means for applying a lifting force on the holder and the container on substantially the central axis of the container for fulcruming the holder about the bail and biasing the leg into locking engagement with the outer edge of the lip.

* * * * *